US009845624B2

(12) United States Patent
Erices

(10) Patent No.: US 9,845,624 B2
(45) Date of Patent: Dec. 19, 2017

(54) LOCK FOR A MOTOR VEHICLE DOOR

(71) Applicant: Kiekert Aktiengesellschaft, Heiligenhaus (DE)

(72) Inventor: Bernardo Erices, Bergisch-Gladbach (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 254 days.

(21) Appl. No.: 14/655,075

(22) PCT Filed: Dec. 5, 2013

(86) PCT No.: PCT/DE2013/000766
§ 371 (c)(1),
(2) Date: Jun. 24, 2015

(87) PCT Pub. No.: WO2014/090212
PCT Pub. Date: Jun. 19, 2014

(65) Prior Publication Data

US 2015/0368938 A1 Dec. 24, 2015

(30) Foreign Application Priority Data

Dec. 15, 2012 (DE) ..... 20 2012 012 039 U

(51) Int. Cl.
*E05C 1/06* (2006.01)
*E05B 85/22* (2014.01)
(Continued)

(52) U.S. Cl.
CPC ..... *E05B 85/22* (2013.01); *E05B 81/06* (2013.01); *E05B 81/16* (2013.01); *E05B 81/28* (2013.01);
(Continued)

(58) Field of Classification Search
CPC ..... Y10T 292/1021; Y10T 292/1082; Y10T 292/306; Y10T 292/307; Y10T 292/308
See application file for complete search history.

(56) References Cited

U.S. PATENT DOCUMENTS 4,269,440 A * 5/1981 Gelhard ..... E05B 81/06 292/201
4,290,634 A * 9/1981 Gelhard ..... E05B 81/25 292/201
(Continued)

FOREIGN PATENT DOCUMENTS

DE 19610708 A1 2/1997
DE 10240003 A1 3/2004
(Continued)

OTHER PUBLICATIONS

Machine Translation of DE102004011798B3 by Lexis Nexis Total Patent on Sep. 9, 2015.
(Continued)

*Primary Examiner* — Carlos Lugo
(74) *Attorney, Agent, or Firm* — Woodard, Emhardt, Moriarty, McNett & Henry LLP

(57) ABSTRACT

The invention relates to a lock for a motor vehicle door with: a locking mechanism; an actuating lever assembly which acts upon the locking mechanism; and a drive unit for at least one lever of the actuating lever assembly. The drive unit comprises at least one motor and a bolt which is acted upon by the motor and is provided with a recess for at least one output shaft of the motor.

20 Claims, 3 Drawing Sheets

(51) Int. Cl.

| | |
|---|---|
| ***E05B 81/28*** | (2014.01) |
| ***E05B 81/06*** | (2014.01) |
| ***E05B 81/16*** | (2014.01) |
| ***E05B 81/34*** | (2014.01) |
| *E05C 3/06* | (2006.01) |

(52) U.S. Cl.

CPC ..... *E05B 81/34* (2013.01); *Y10T 292/102* (2015.04); *Y10T 292/1021* (2015.04); *Y10T 292/1082* (2015.04); *Y10T 292/307* (2015.04); *Y10T 292/308* (2015.04)

(56) References Cited

U.S. PATENT DOCUMENTS 4,902,052 A * 2/1990 Laine ..... E05B 47/0002 292/144
5,180,198 A 1/1993 Nakamura et al.
5,232,253 A * 8/1993 Tamiya ..... E05B 81/20 292/201
5,791,179 A * 8/1998 Brask ..... E05B 13/004 292/142
6,079,757 A * 6/2000 Aubry ..... E05B 77/28 292/201
6,318,196 B1 * 11/2001 Chang ..... E05B 81/25 292/144
6,497,162 B2 * 12/2002 Spurr ..... E05B 81/25 292/201
6,983,962 B2 * 1/2006 Keightley ..... E05B 15/10 292/142
7,114,407 B1 * 10/2006 Colin ..... F16H 19/04 74/89.18
2007/0126243 A1 * 6/2007 Papanikolaou ..... E05B 81/06 292/201

FOREIGN PATENT DOCUMENTS

| | | |
|---|---|---|
| DE | 102004011798 B3 | 10/2005 |
| EP | 1253268 A2 | 10/2002 |
| GB | 2342950 | 4/2000 |

OTHER PUBLICATIONS

Machine Translation of DE10240003A1 by Lexis Nexis Total Patent on Sep. 9, 2015.
Machine Translation of DE19610708A1 by Lexis Nexis Total Patent on Sep. 9, 2015.

* cited by examiner

LOCK FOR A MOTOR VEHICLE DOOR

CROSS-REFERENCE TO RELATED APPLICATIONS

This application is the U.S. national stage application of International Patent Application No. PCT/DE2013/000766, filed Dec. 5, 2013, which claims priority of German Application No. 20 2012 012 039.5, filed Dec. 15, 2012, which are both hereby incorporated by reference.

BACKGROUND

The invention relates to a motor vehicle door latch containing a locking mechanism, an actuating lever assembly that acts on the locking mechanism and a drive unit for at least one lever of the actuating lever assembly, in which the drive unit contains at least one motor and a bolt acted upon by the motor.

The lever of the actuating lever assembly acted on by the drive unit is often a locking lever and, in particular, a central locking lever. Such locking levers or central locking lever are generally pivoted by means of an eccentric control journal engaging in a respective fork-shaped recess of the central locking lever (see for instance DE 102 40 003 A1).

A generic motor vehicle door latch according to DE 10 2004 011 798 B3 provides a motorized closing and opening aid for a motor vehicle door. This contains a first output element, acting as a closing aid, which pivots the catch as part of the locking mechanism from its pre-ratchet position into a main ratchet position. A second output element acts as an opening aid and lifts the respective pawl off the catch. As a result, the released catch can be pivoted back to its open position by the force of a spring.

Both output elements are arranged on a common output gear. When turning the output gear in one rotation direction, the first output element is effective, whilst the second output element is ineffective and vice versa. The second output element acting as an opening aid is a longitudinally moveable bolt.

A further state of the art disclosed in DE 196 10 708 A1 describes a door securing unit for motor vehicles. This is located in the immediate vicinity of a locking pin of motor vehicle doors and can be controlled by means of an electric impulse. For this purpose, an electric motor is provided in a housing with one or more locking pins being assigned to the electric motor. The locking pin contains a gear rack section meshing with a toothed gear, acted upon by the motor. In this way, the locking pin can be linearly moved out of the housing.

In drive units with at least one motor and a bolt of the aforementioned design that is acted on by the motor, in particular in an embodiment containing a toothed rod and pinion engaging therein, the problem occurs that radial forces act or can act on the pinion and the bolt or the toothed rod. Such radial forces do, for instance, arise when the movement of the bolt is impeded (by friction) or if the bolt moves against a stop. The overall result can be that the pinion no longer meshes with the teeth of the toothed rod. Depending on the stressing or number of duty cycles this can result in damage of the tooth flanks or even tooth fracturing. This may cause malfunctioning of the drive unit and thus of the entire motor vehicle door latch.

Given the described problems, efforts are currently being made to manufacture and mesh the pinion and toothed rod with the lowest possible tolerances. Furthermore, efforts are made to increase the stiffness of the meshing elements, to exclude most or at least as far as possible any of the described deformation generated by the radial forces. This results in higher manufacturing costs, which is a problem given the enormous cost pressure in the manufacture of motor vehicle accessories. The invention aims to provide a solution for this.

SUMMARY

The invention is based on the technical problem of further developing a motor vehicle door lock of the described design in such a way that whilst ensuring correct functioning, production costs are reduced.

In order to solve this technical problem, a generic motor vehicle door latch of the invention is characterized by the bolt containing a seat for at least one output shaft of the motors.

Generally, the head end of the output shaft is mounted in the seat. The seat also radially supports the output shaft. This is particularly significant as the bolt is in most cases designed as a toothed rod arrangement and as an output pinion of the output shaft of the motor engages in teeth of the bolt or of the toothed rod arrangement.

In this way the output shaft of the motor is radially supported in the seat of the bolt. As a result of the invention there is thus no longer any danger of the output shaft radially evading the bolt when subjected to forces. Instead, the head of the output shaft is perfectly supported, held and guided in the seat. As a result, the output pinion located on the output shaft continuously and correctly engages in the teeth of the bolt after the head has entered the seat.

As a result, the output pinion and/or the bolt can be produced with a greater tolerance and/or less rigidity than before. In this way it is, for instance possible to produce the bolt from plastic or metal. This not only reduces costs but also the weight of the inventive motor vehicle door latch compared to prior art embodiments. Given increasing motor vehicle weights, such a reduction in weight is particularly advantageous. The seat for the output shaft of the motor provided in the bolt always ensures that the axle distance or radial distance of the output shaft in relation to the bolt practically remains constant. This means that the output pinion—in contrast to prior art embodiments—cannot (can no longer) evade the teeth with which the output pinion meshes. These are the main advantages.

In an advantageous embodiment the seat is a slotted hole. The slotted hole has a certain specified axial length. This axial length actually determines the travel of the bolt. The bolt moves predominantly linearly in relation to the motor. As the head of the output shaft engages in the seat or slotted hole, the axial extension of this slotted hole only defines the linear movement of the bolt. The slotted hole also has an internal width adapted to the diameter of the output shaft. This adjustment rule ensures that the head of the output shaft is radially supported in the seat, as described.

The bolt generally has an L-shaped cross section. The two L-legs defined in this manner are on one hand a drive leg and, on the other hand, a guide leg. The underside of the drive leg contains the teeth of the bolt, designed as a toothed rod arrangement. The output pinion meshes with the teeth. In contrast, the front of the guide leg contains the seat for the output shaft. Viewed as a cross section, the output pinion essentially fills the room between the two L legs. As a result, the output pinion is typically protected in the area between the two L legs below the drive leg.

This arrangement increases functional reliability and protects the output pinion and the teeth provided on the underside of the drive leg against any damage or soiling. This is of special significance given that the output pinion and/or the bolt can be made from plastic.

The drive unit, specially designed according to the invention can generally act on any lever of the actuating lever assembly in order to adjust it. Generally, it has proven to be advantageous for the bolt to act on a locking lever and/or coupling lever as part of the actuating lever assembly, in order to adjust it. It is, for instance, feasible that the drive unit acting on a locking lever moves the locking lever and thus the entire motor vehicle door latch into the "locked" or "unlocked" position. In a similar manner, the drive unit can act on a coupling lever, selectively mechanically interrupting or closing the actuating lever assembly.

An interruption of the actuating lever assembly typically corresponds to the "locked" state and a continuous mechanical connection between, for instance, a handle and the locking mechanism to be interrupted. The "unlocked" state in contrast corresponds to the coupling lever closing the actuating lever assembly with the aid of the drive unit so that the acted upon handle can open the locking mechanism.

The described procedures are naturally only examples. The decisive fact is that the output shaft is guided in the seat of the bolt and can consequently not (no longer) radially evade the bolt, even if forces are exerted. This ensures a continuous correct engagement of the output pinion in the teeth of the bolts even when the bolt and/or the output pinion are not as rigid as prior art embodiments. Any tolerances between the output pinion and the teeth can also be managed. This alone produces significant cost savings whilst maintaining the correct functionality. These are the main advantages of the invention.

Below, the invention is explained with reference to drawings showing only one embodiment, in which:

DETAILED DESCRIPTION OF THE DRAWINGS

Figure 3:
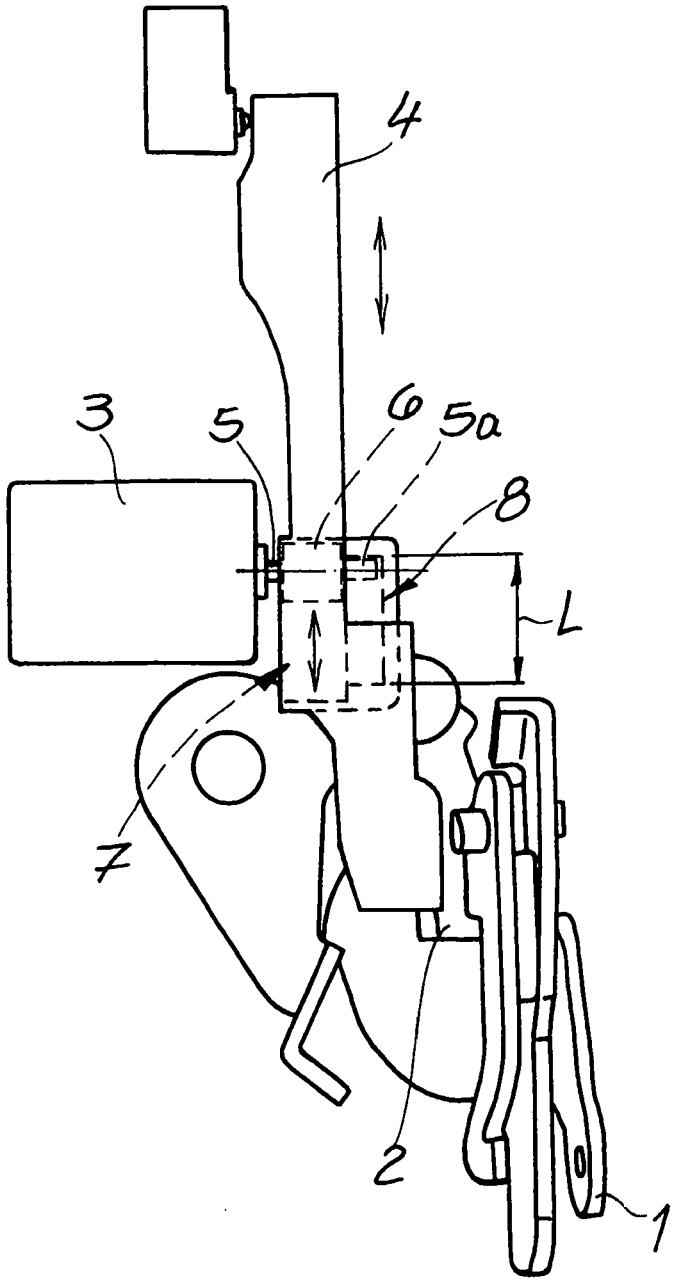
FIG. 3 shows a section of the motor vehicle door latch of the invention with the drive unit as shown in FIGS. 1 and 2.

The figures show a motor vehicle door latch containing as usual a locking mechanism—not shown in the embodiment—which is generally located or arranged on a level below the level shown in FIG. 3. In the shown embodiment, a release lever 1 acts on the locking mechanism which ensures or can ensure that a pawl is lifted off a catch as a respective component of the locking mechanism. FIG. 3 also shows a locking lever 2 that can be pivoted with the aid of a drive unit 3, 4.

In order to achieve this, a motor 3 of the drive unit 3, 4 acts on a sliding member 4—starting from the "locked" functional state in FIG. 3—in such a way that the sliding member 4 carries out an upwards movement. As a result, the sliding member 4 is released from the engagement with the locking lever 2. In the "locked" position shown in FIG. 3, the release lever 1 is unable to open the locking mechanism. A mechanical coupling of a handle to the shown actuating lever assembly by means of the release lever 1 and the locking lever 2 up to the locking mechanism, is interrupted. Any activation of the handle results in an idle stroke.

In contrast, the "unlocked" position not shown, corresponds to the sliding member 4 being moved "up" compared to its functional position in FIG. 3 and releases the locking lever 2. The lever can assume its "unlocked" position and ensures, as a whole, a continuous mechanical connection from the handle and the release lever 1 up to the locking mechanism. As a result, activation of the handle is directly translated into opening of the locking mechanism. This is the usual function.

Figure 1:
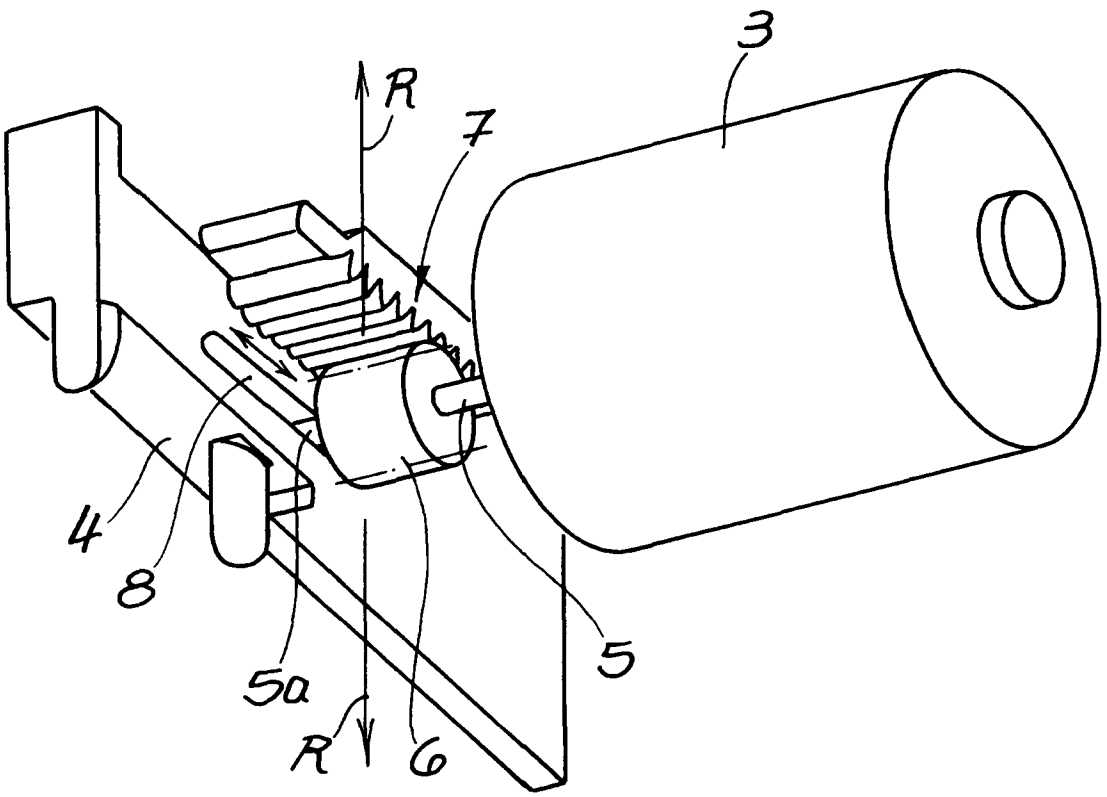
FIG. 1 shows a perspective view of a drive unit for a motor vehicle door latch of the invention.
Figure 2:
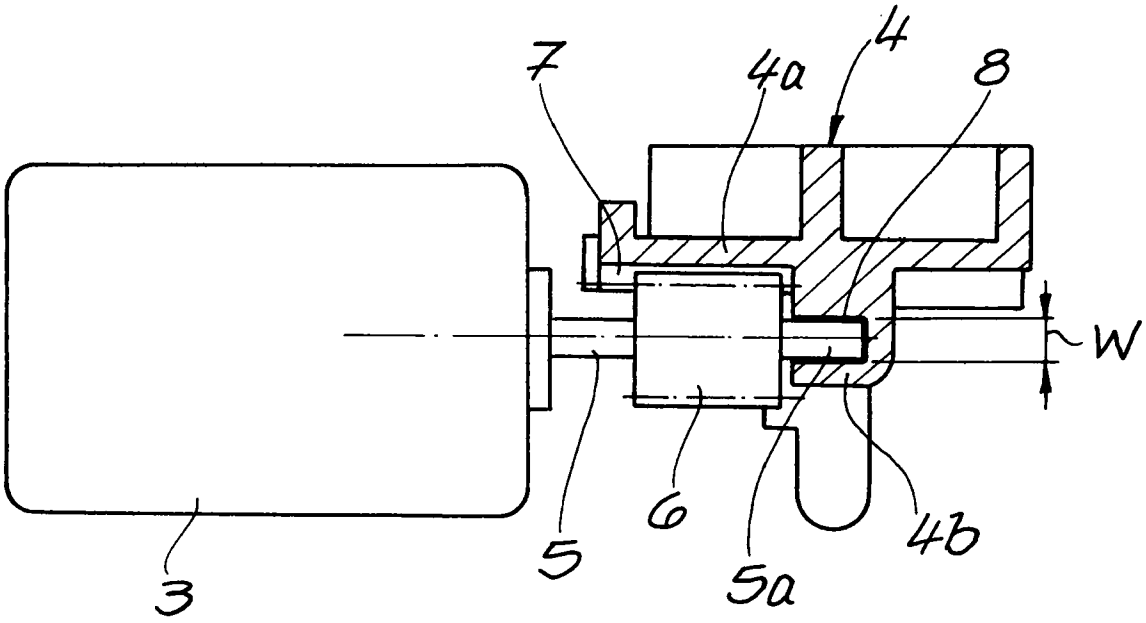
FIG. 2 shows a partially sectional side view of the object of FIG. 1

The drive unit 3, 4 is now explained in detail with reference to FIGS. 1 and 2. The motor 3 is an electric motor. The motor 3 acts on the sliding member 4, which as a result carries out linear movements, as indicated by the double arrows in FIG. 3. During such movements it can occur that radial forces R act on the sliding member 4 as indicated by respective arrows in FIG. 1. In order to ensure that the motor 3 can still move the sliding member 4 correctly when exposed to such radial forces R, an output shaft 5 of the motor 3 is equipped with an output pinion 6, engaging in the teeth 7 of the sliding member 4. The sliding member 4 is thus a toothed rod arrangement.

Particularly significant for the invention is the fact that the sliding member 4 contains a seat 8 for the output shaft 5 of the motor 3. This seat 8 accommodates the head of the output shaft 5 or a head 5*a* of the output shaft 5 enters the respective seat 8.

As the output shaft 5 is generally cylindrical or is a cylindrical pin, the head 5*a* of the output shaft 5 is thus a cylindrical section. This cylindrical section is accommodated in the U-shaped seat 8 and is radially supported. This means that any radial forces R acting on the output pinion 6 and/or the sliding member 4 as indicated in FIG. 1 do as a result of the invention not (no longer) cause the radial distance between the output shaft 5 and the teeth 7 or the sliding member 4 to be changed. Instead it is ensured that even under such radial forces R, the output pinion 6 meshes correctly with the teeth 7.

All in all the arrangement is such that the output pinion 6 is arranged after the head 5*a* on the output shaft 5 of the motor 3 in the direction of the motor 3. The head 5*a* of the output shaft 5 on the other hand engages in the seat 8 in the sliding member 4. The seat 8 is in this case designed as a slotted hole, as apparent when comparing FIGS. 2 and 3. The seat or slotted hole also has an axial length L, defining a respective travel of the sliding member 4, also of the length L (see FIG. 3). In addition, the slotted hole or seat 8 has an internal width that is adapted to a diameter of the output shaft 5. This is apparent from the cross sectional view of FIG. 2.

As a result the already described radial support of the output shaft 5 is provided, at the same time defining and restricting the travel of the length L of the slider 4, thus increasing functional reliability.

This is also aided by the fact that the sliding member 4 essentially has an L-shaped cross section. The figures actually show a drive leg 4*a* and a guide leg 4*b*. The drive leg 4*a* contains the teeth 7 on is underside into which the output pinion 6 engages. In contrast, the front side of the guide leg 4*b* contains the seat or slotted hole 8 for the output shaft 5 or the head 5*a* of the output shaft 5. The L-shaped cross section of the sliding member 4 defines a space between the two L-legs 4*a*, 4*b*. The output pinion 6 essentially fills this room between the two L-legs 4*a*, 4*b* and is consequently protected and arranged below the sliding member 4. The same applies for the teeth 7, so that any damage, soiling, etc. of the teeth 7 and of the output pinion 6 are restricted to a minimum.

The output pinion 6 and/or the sliding member 4 can thus be made of plastic or can be designed as an injection-molded plastic part. Generally it is, however, alternatively or in addition also possible to produce the output pinion 6 and/or sliding member 4 from metal, for instance by metal die casting.

The invention claimed is:

1. Motor vehicle door latch including a locking mechanism, the motor vehicle door latch comprising an actuating lever assembly, which acts on the locking mechanism, and a drive unit for driving at least one lever of the actuating lever assembly, in which the drive unit comprises a motor, an output shaft extending from the motor, an output pinion mounted on the output shaft, and a sliding member operatively connected to the motor, wherein the sliding member includes a plurality of teeth and a longitudinal groove that defines a U-shaped cross section seat that receives the output shaft of the motor, wherein the output pinion engages the teeth of the sliding member, wherein a head of the output shaft has a cylindrical section received in the U-shaped seat and radially supported thereof.

2. Motor vehicle door latch according to claim 1, wherein the sliding member is designed as a toothed rod arrangement.

3. Motor vehicle door latch according to claim 2, wherein the output pinion is arranged on the output shaft behind a head accommodated in the seat.

4. Motor vehicle door latch according to claim 3, wherein the seat is a slotted hole.

5. Motor vehicle door latch according to claim 4, wherein an axial length of the slotted hole defines a travel of the sliding member.

6. Motor vehicle door latch according to claim 5, wherein the seat has an internal width adjusted to a diameter of the output shaft.

7. Motor vehicle door latch according to claim 1, wherein the output pinion is arranged on the output shaft behind a head accommodated in the seat.

8. Motor vehicle door latch according to claim 1, wherein the seat is a slotted hole.

9. Motor vehicle door latch according to claim 8, wherein an axial length of the slotted hole defines a travel of the sliding member.

10. Motor vehicle door latch according to claim 1, wherein the seat has an internal width adjusted to a diameter of the output shaft.

11. Motor vehicle door latch according to claim 1, wherein a cross section of the sliding member is essentially L-shaped with a drive leg and a guide leg.

12. Motor vehicle door latch according to claim 11, wherein an underside of the output pinion contains the teeth into which the output pinion engages.

13. Motor vehicle door latch according to claim 12, wherein the U-shaped seat is located in the guide leg with the U-shaped seat spaced apart from the plurality of teeth with the plurality of teeth positioned adjacent to the guide leg.

14. Motor vehicle door latch according to claim 11, wherein the front of the guide leg contains the seat for the output shaft.

15. Motor vehicle door latch according to claim 11, wherein a cross section of the output pinion essentially fills the space between the two L legs.

16. Motor vehicle door latch according to claim 1, wherein the sliding member is made from plastic and/or metal.

17. Motor vehicle door latch according to claim 1, wherein the sliding member acts on a locking lever and/or coupling lever as a component of the actuating lever assembly in order to move said lever.

18. Motor vehicle door latch according to claim 1, wherein the drive unit moves the sliding member linearly.

19. Motor vehicle door latch according to claim 1, wherein the plurality of teeth on the sliding member define a straight rack.

20. Motor vehicle door latch according to claim 1, wherein engagement of the output shaft in the U-shaped seat resists movement of the output shaft away from the plurality of teeth.

* * * * *